US012595566B1

(12) United States Patent
Roper et al.

(10) Patent No.: US 12,595,566 B1
(45) Date of Patent: Apr. 7, 2026

(54) YTTRIUM-CONTAINING AND/OR LUTETIUM-CONTAINING HIGH-TEMPERATURE COATINGS

(71) Applicant: HRL Laboratories, LLC, Malibu, CA (US)

(72) Inventors: Christopher Roper, Oak Park, CA (US); William Evans O'Connor, Munich (DE)

(73) Assignee: HRL Laboratories, LLC, Malibu, CA (US)

( * ) Notice: Subject to any disclaimer, the term of this patent is extended or adjusted under 35 U.S.C. 154(b) by 160 days.

(21) Appl. No.: 18/217,691

(22) Filed: Jul. 3, 2023

(51) Int. Cl.
*C23C 28/00* (2006.01)

(52) U.S. Cl.
CPC ..... *C23C 28/3455* (2013.01)

(58) Field of Classification Search
CPC ..... C23C 28/3455
USPC ..... 428/469
See application file for complete search history.

(56) References Cited

U.S. PATENT DOCUMENTS

2005/0079368 A1* 4/2005 Gorman ..... C25D 5/48 427/446
2021/0047968 A1* 2/2021 Matsudaira ..... F02C 7/24
2024/0344167 A1* 10/2024 Shi ..... C23C 28/30

* cited by examiner

*Primary Examiner* — Katherine A Christy
(74) *Attorney, Agent, or Firm* — O'Connor & Company; Ryan P. O'Connor

(57) ABSTRACT

An yttrium-containing structure comprises: (a) a substrate layer comprising a metal alloy, a ceramic material, a ceramic composite, or a combination thereof; (b) a bond-coat layer disposed on the substrate layer, or on an optional interlayer that is on the substrate layer, wherein the bond-coat layer comprises yttrium and a noble metal selected from the group consisting of platinum, iridium, rhenium, ruthenium, rhodium, osmium, and/or palladium; (c) a thermally grown oxide layer disposed on the bond-coat layer, wherein the thermally grown oxide layer comprises yttrium oxide; and (d) optionally, a top-coat layer disposed on the thermally grown oxide layer, wherein the top-coat layer comprises a metal oxide, a metal pyrochlore, or a metal silicate. Yttrium may be replaced with lutetium, in which the bond-coat layer comprises lutetium and a noble metal (e.g., Pt or Ir). A mixture of yttrium and lutetium may also be employed.

29 Claims, 5 Drawing Sheets

YTTRIUM-CONTAINING AND/OR LUTETIUM-CONTAINING HIGH-TEMPERATURE COATINGS

STATEMENT OF GOVERNMENT RIGHTS

This invention was made with Government support under Contract No. HR0011-21-C-0043 awarded by the U.S. Department of Defense. The Government has certain rights in this invention.

FIELD OF THE INVENTION

The present invention generally relates to thermal barrier coatings that survive at high use temperatures.

BACKGROUND OF THE INVENTION

Thermal barrier coatings are highly advanced material systems usually applied to surfaces operating at elevated temperatures, such as gas turbines or aero-engine parts. Thermal barrier coatings serve to insulate components from large and prolonged heat loads by utilizing thermally insulating materials which can sustain an appreciable temperature difference between the load-bearing materials and the coating surface. In doing so, these coatings can allow for higher operating temperatures while limiting the thermal exposure of structural components, thereby extending part life.

In certain commercial applications, materials are desired that possess low thermal conductivity and low heat capacity, while fulfilling requirements of high-temperature capability and structural integrity during repeated temperature cycling and operational stresses and mechanical loads. Materials with low thermal conductivity are of interest when thermal protection is necessary or when heat loss is undesired. Materials with low heat capacity are of interest for applications in which temperature swings are encountered and when the insulation material should not significantly affect the temperature swing.

To be useful, a thermal barrier coating needs to be effectively coated onto an underlying substrate, which is often a metal alloy for structural strength. A bond coat is used to adhere a ceramic top coat to the substrate. In many systems, the bond coat is the most crucial component in the thermal barrier coating, critically affecting the stability and durability of the thermal barrier coating. The chemistry and microstructure of the bond coat are dependent on its compositions and synthesis procedure.

Conventionally, there are two main categories of bond coats, both being alumina-based bond coats. One category is MCrAlY (M=Co, Fe, or Ni) bond coats, and the other category is Ni—Pt—Al diffusion bond coats. These are both alumina-based bond coats because, during high-temperature service, aluminum oxidizes to alumina, $Al_2O_3$, in a thermally grown oxide (TGO) layer. A MCrAlY bond coat is a thermally sprayed coating that has an operating temperature up to 1200° C. This coating has been conventionally used for nickel-based substrates. Refractory metal and ceramic substrates in development require higher-operating-temperature bond coats that are not nickel-based. Ni—Pt—Al diffusion bond coats have better adherence and performance compared to MCrAlY based on the quality of TGO layer. However, the slurry-based methods of diffusing Pt—Al into a nickel substrate are not directly transferable to refractory metal substrates due to unfavorable intermetallics, and are not feasible for ceramics in general.

Bond coats may serve other purposes, besides adhering a ceramic top coat to a substrate. A bond coat can also protect superalloy substrates from chemical attacks such as oxidation. Also, in alumina-based bond coats, the bond coat can provide a reservoir from which Al can diffuse to form a protective $\alpha$-$Al_2O_3$ layer.

Both MCrAlY and Ni—Pt—Al bond coats result in distinct TGO features as well as differing tendencies to plastic deformation. Accordingly, the failure mechanisms are often different. TGO growth and interdiffusion with the substrate contribute to bond coat changes in terms of chemistry and phase structures. Dislocations can be promoted by softening or local volume changes arising from phase transformations in the bond coat. Impurities migrating from the substrate can embrittle the interface or produce local oxide penetrations. Al depletion from the bond coat can reduce the ability of the bond coat to sustain protective $Al_2O_3$ growth and destabilize the TGO layer by introducing unwanted elements that form interphases with lower toughness or adherence. Thermal stress relaxation by plastic flow of the bond coat can lead to cracking of the TGO layer upon reheating, giving rise to local oxide penetrations.

Bond coats therefore have significant influence on the durability of the overall thermal barrier coating, through the structure and morphology of a TGO layer formed in service. Thermal barrier coating failure is often observed at the interface between the bond coat and the TGO, between the TGO and the ceramic top coat, or within the TGO. Thus, increasing the adhesion and integrity of the interfacial TGO layer may contribute to the reliability of thermal barrier coatings. Often, the onset of thermal barrier coating spallation is triggered by microstructural imperfections at or close to the TGO layer. These imperfections convert multilayer stresses into a driving force for failure by crack initiation, propagation at the interface, and large-scale buckling.

In view of the aforementioned prior art, improved bond-coat compositions, and structures (e.g., thermal barrier coatings and systems) incorporating such bond-coat compositions, are strongly desired.

SUMMARY OF THE INVENTION

Some variations of the invention provide a yttrium-containing structure comprising:

(a) a substrate layer comprising a metal alloy, a ceramic material, a ceramic composite, or a combination thereof;

(b) a bond-coat layer disposed on the substrate layer, or on an optional interlayer that is disposed on the substrate layer, wherein the bond-coat layer comprises yttrium and a noble metal selected from the group consisting of platinum, iridium, rhenium, ruthenium, rhodium, osmium, palladium, and combinations thereof, (c) a thermally grown oxide layer disposed on the bond-coat layer, wherein the thermally grown oxide layer comprises yttrium oxide; and (d) optionally, a top-coat layer disposed on the thermally grown oxide layer, wherein the top-coat layer comprises a metal oxide, a metal pyrochlore, or a metal silicate.

In some embodiments, the metal alloy is selected from the group consisting of Nb alloys, Mo alloys, Ta alloys, W alloys, V alloys, and combinations thereof.

In some embodiments, the ceramic material is selected from the group consisting of aluminum nitride, boron nitride, hafnium carbide, hafnium diboride, hafnium nitride, silicon carbide, silicon nitride, tantalum carbide, titanium carbide, titanium diboride, titanium nitride, zirconium carbide, zirconium diboride, zirconium nitride, and combinations thereof.

In some embodiments, the ceramic composite is selected from the group consisting of carbon-carbon, carbon-silicon carbide, carbon-hafnium carbide, carbon-zirconium carbide, silicon carbide-silicon carbide, and combinations thereof.

In some embodiments, the substrate layer has a thickness from about 10 microns to about 50 millimeters.

In some embodiments, the bond-coat layer has a thickness from about 5 nanometers to about 500 microns.

In some embodiments, the bond-coat layer comprises from about 15 mol % to about 50 mol % of the yttrium, and from about 50 mol % to about 85 mol % of the platinum.

In some embodiments, the bond-coat layer comprises from about 15 mol % to about 35 mol % of the yttrium, and from about 65 mol % to about 85 mol % of the iridium.

In some embodiments, the bond-coat layer comprises from about 15 mol % to about 50 mol % of the yttrium, and from about 50 mol % to about 85 mol % of the rhenium.

In some embodiments, the bond-coat layer comprises from about 15 mol % to about 50 mol % of the yttrium, and from about 50 mol % to about 85 mol % of the ruthenium.

In some embodiments, within the thermally grown oxide layer, the yttrium oxide is $Y_2O_3$.

In some embodiments, the bond-coat layer further comprises lutetium. In these embodiments, the thermally grown oxide layer may further comprise lutetium oxide (e.g., $Lu_2O_3$), such that the thermally grown oxide layer may be a mixture of $Y_2O_3$ and $Lu_2O_3$, for example.

In some embodiments, the thermally grown oxide layer has a thickness from about 10 nanometers to about 100 microns.

When the interlayer is present in the yttrium-containing structure, the interlayer may have a thickness from about 5 nanometers to about 100 microns, for example. The interlayer may comprises platinum, iridium, rhenium, ruthenium, rhodium, osmium, palladium, or a combination thereof. These metals may be present in pure form or as compounds, such as oxides, nitrides, carbides, hydrides, hydroxides, intermetallic compounds, metal alloys, or a combination thereof, for example.

When the top-coat layer is present in the yttrium-containing structure, the top-coat layer may have a thickness from about 10 nanometers to about 1 millimeter, for example. In the top-coat layer, a metal oxide may be selected from rare earth oxides, such as yttria, ceria, gadolinia, lanthana, lutecia, scandia, zirconia, hafnia, or a combination thereof. A metal pyrochlore may be selected from rare earth pyrochlores, such as gadolinium zirconate, lanthanum zirconate, neodymium hafnate, or a combination thereof. A metal silicate may be selected from rare earth silicates or refractory metal silicates, such as hafnium silicate, yttrium silicate, lutetium silicate, lutetium-yttrium silicate, scandium silicate, scandium-yttrium silicate, zirconium silicate, lanthanum-gallium silicate, gadolinium oxyorthosilicate, or a combination thereof.

Other variations of the invention provide a yttrium-containing intermediate structure comprising:

(a) a substrate layer comprising a metal alloy, a ceramic material, a ceramic composite, or a combination thereof;

(b) optionally, an interlayer disposed on the substrate layer;

(c) a bond-coat layer disposed on the substrate layer, or on the interlayer if present, wherein the bond-coat layer comprises yttrium and a noble metal selected from the group consisting of platinum, iridium, rhenium, ruthenium, rhodium, osmium, palladium, and combinations thereof, and (d) optionally, a top-coat layer disposed on the bond-coat layer, wherein the top-coat layer comprises a metal oxide, a metal pyrochlore, or a metal silicate.

The yttrium-containing intermediate structure may be a structure that has not yet been exposed to oxygen to form a thermally grown oxide (TGO) layer that contains oxidized yttrium. Alternatively, the yttrium-containing intermediate structure may be a structure that never contains a thermally grown oxide layer. Alternatively, the yttrium-containing intermediate structure may be a structure that previously contained a thermally grown oxide layer but such layer has been removed, such as by chemical reduction that converts yttrium oxide back to elemental yttrium.

For TGO layer fabrication, the oxidation conditions are preferably selected such that some, but not all, of the yttrium is converted to yttrium oxide. In some embodiments, the conversion of yttrium to yttrium oxide is selected from about 1% to about 50%, such as from about 5% to about 30%, based on the total content of yttrium in the starting bond-coat layer.

In some embodiments of the yttrium-containing intermediate structure, the bond-coat layer comprises from about 15 mol % to about 50 mol % of the yttrium, and from about 50 mol % to about 85 mol % of the platinum.

In some embodiments, the bond-coat layer comprises from about 15 mol % to about 35 mol % of the yttrium, and from about 65 mol % to about 85 mol % of the iridium.

In some embodiments, the bond-coat layer comprises from about 15 mol % to about 50 mol % of the yttrium, and from about 50 mol % to about 85 mol % of the rhenium.

In some embodiments, the bond-coat layer comprises from about 15 mol % to about 50 mol % of the yttrium, and from about 50 mol % to about 85 mol % of the ruthenium.

In some embodiments, the bond-coat layer further comprises lutetium.

The substrate layer in the yttrium-containing intermediate structure may have a thickness from about 10 microns to about 10 millimeters, for example.

The bond-coat layer in the yttrium-containing intermediate structure may have a thickness from about 5 nanometers to about 500 microns, for example.

An interlayer may be present in the yttrium-containing intermediate structure. The interlayer may have a thickness from about 5 nanometers to about 100 microns, for example. The interlayer may comprise platinum, iridium, rhenium, ruthenium, rhodium, osmium, palladium, or a combination thereof. These metals may be present in pure form or as compounds, such as oxides, nitrides, carbides, hydrides, hydroxides, intermetallic compounds, metal alloys, or a combination thereof, for example.

A top-coat layer may be present in the yttrium-containing intermediate structure. The top-coat layer may have a thickness from about 10 nanometers to about 1 millimeter, for example.

Some variations of the invention provide a lutetium-containing structure comprising:

(a) a substrate layer comprising a metal alloy, a ceramic material, a ceramic composite, or a combination thereof;

(b) a bond-coat layer disposed on the substrate layer, or on an optional interlayer that is disposed on the substrate layer, wherein the bond-coat layer comprises lutetium and a noble metal selected from the group consisting of platinum, iridium, rhenium, ruthenium, rhodium, osmium, palladium, and combinations thereof, (c) a thermally grown oxide layer disposed on the bond-coat layer, wherein the thermally grown oxide layer comprises lutetium oxide; and (d) optionally, a top-coat layer disposed on the thermally grown oxide layer, wherein the top-coat layer comprises a metal oxide, a metal pyrochlore, or a metal silicate.

In some embodiments of lutetium-containing structures, the metal alloy is selected from the group consisting of Nb alloys (e.g., C-103), Mo alloys (e.g., titanium-zirconium-molybdenum, TZM), Ta alloys (e.g., Tantaloy 63), W alloys (e.g., W-25Re), V alloys (e.g., V-20Ti), other refractory alloys, and combinations thereof.

In some embodiments of lutetium-containing structures, the ceramic material is selected from the group consisting of aluminum nitride, boron nitride, hafnium carbide, hafnium diboride, hafnium nitride, silicon carbide, silicon nitride, tantalum carbide, titanium carbide, titanium diboride, titanium nitride, zirconium carbide, zirconium diboride, zirconium nitride, and combinations thereof.

In some embodiments of lutetium-containing structures, the ceramic composite is selected from the group consisting of carbon-carbon, carbon-silicon carbide, carbon-hafnium carbide, carbon-zirconium carbide, silicon carbide-silicon carbide, and combinations thereof.

In some embodiments of lutetium-containing structures, the substrate layer has a thickness from about 10 microns to about 50 millimeters.

In some embodiments of lutetium-containing structures, the bond-coat layer has a thickness from about 5 nanometers to about 500 microns.

In some embodiments of lutetium-containing structures, the bond-coat layer comprises from about 15 mol % to about 50 mol % of the lutetium, and from about 50 mol % to about 85 mol % of the platinum.

In some embodiments of lutetium-containing structures, the bond-coat layer comprises from about 15 mol % to about 35 mol % of the lutetium, and from about 65 mol % to about 85 mol % of the iridium.

In some embodiments of lutetium-containing structures, the bond-coat layer comprises from about 15 mol % to about 50 mol % of the lutetium, and from about 50 mol % to about 85 mol % of the rhenium.

In some embodiments of lutetium-containing structures, the bond-coat layer comprises from about 15 mol % to about 50 mol % of the lutetium, and from about 50 mol % to about 85 mol % of the ruthenium.

In some embodiments of lutetium-containing structures, within the thermally grown oxide layer, the lutetium oxide is $Lu_2O_3$.

In some embodiments of lutetium-containing structures, the thermally grown oxide layer has a thickness from about 10 nanometers to about 100 microns.

When the interlayer is present in the lutetium-containing structure, the interlayer may have a thickness from about 5 nanometers to about 100 microns, for example. The interlayer may comprise platinum, iridium, rhenium, ruthenium, rhodium, osmium, palladium, or a combination thereof. These metals may be present in pure form or as compounds, such as oxides, nitrides, carbides, hydrides, hydroxides, intermetallic compounds, metal alloys, or a combination thereof, for example.

When the top-coat layer is present, the top-coat layer may have a thickness from about 10 nanometers to about 1 millimeter, for example.

In some embodiments of lutetium-containing structures, a metal oxide may be selected from rare earth oxides, such as yttria, ceria, gadolinia, lanthana, lutecia, scandia, zirconia, hafnia, or a combination thereof. A metal pyrochlore may be selected from rare earth pyrochlores, such as gadolinium zirconate, lanthanum zirconate, neodymium hafnate, or a combination thereof. A metal silicate may be selected from rare earth silicates or refractory metal silicates, such as hafnium silicate, yttrium silicate, lutetium silicate, lutetium-yttrium silicate, scandium silicate, scandium-yttrium silicate, zirconium silicate, lanthanum-gallium silicate, gadolinium oxyorthosilicate, or a combination thereof.

In some embodiments of lutetium-containing structures, the metal oxide is selected from rare earth pyrochlores, such as gadolinium zirconate, lanthanum zirconate, neodymium hafnate, or a combination thereof.

Still other variations provide a lutetium-containing intermediate structure comprising:

(a) a substrate layer comprising a metal alloy, a ceramic material, a ceramic composite, or a combination thereof;

(b) optionally, an interlayer disposed on the substrate layer;

(c) a bond-coat layer disposed on the substrate layer, or on the interlayer if present, wherein the bond-coat layer comprises lutetium and a noble metal selected from the group consisting of platinum, iridium, rhenium, ruthenium, rhodium, osmium, palladium, and combinations thereof, and (d) optionally, a top-coat layer disposed on the bond-coat layer, wherein the top-coat layer comprises a metal oxide, a metal pyrochlore, or a metal silicate.

For TGO layer fabrication, the oxidation conditions are preferably selected such that some, but not all, of the lutetium is converted to lutetium oxide. In some embodiments, the conversion of lutetium to lutetium oxide is selected from about 1% to about 50%, such as from about 5% to about 30%.

In some embodiments of lutetium-containing intermediate structures, the bond-coat layer comprises from about 15 mol % to about 50 mol % of the lutetium, and from about 50 mol % to about 85 mol % of the platinum.

In some embodiments of lutetium-containing intermediate structures, the bond-coat layer comprises from about 15 mol % to about 35 mol % of the lutetium, and from about 65 mol % to about 85 mol % of the iridium.

In some embodiments of lutetium-containing intermediate structures, the bond-coat layer comprises from about 15 mol % to about 50 mol % of the lutetium, and from about 50 mol % to about 85 mol % of the rhenium.

In some embodiments of lutetium-containing intermediate structures, the bond-coat layer comprises from about 15 mol % to about 50 mol % of the lutetium, and from about 50 mol % to about 85 mol % of the ruthenium.

In some embodiments of lutetium-containing intermediate structures, the metal oxide is selected from rare earth oxides or rare earth pyrochlores.

In some embodiments of lutetium-containing intermediate structures, the substrate layer has a thickness from about 10 microns to about 50 millimeters, for example.

In some embodiments of lutetium-containing intermediate structures, the bond-coat layer has a thickness from about 5 nanometers to about 500 microns, for example.

In some embodiments of lutetium-containing intermediate structures, the interlayer is present and has a thickness from about 5 nanometers to about 100 microns, for example, and the interlayer optionally comprises platinum, iridium, rhenium, ruthenium, rhodium, osmium, palladium, or a combination thereof.

In some embodiments of lutetium-containing intermediate structures, the top-coat layer is present and has a thickness from about 10 nanometers to about 1 millimeter, for example.

DETAILED DESCRIPTION OF EMBODIMENTS OF THE INVENTION

Figure 1:
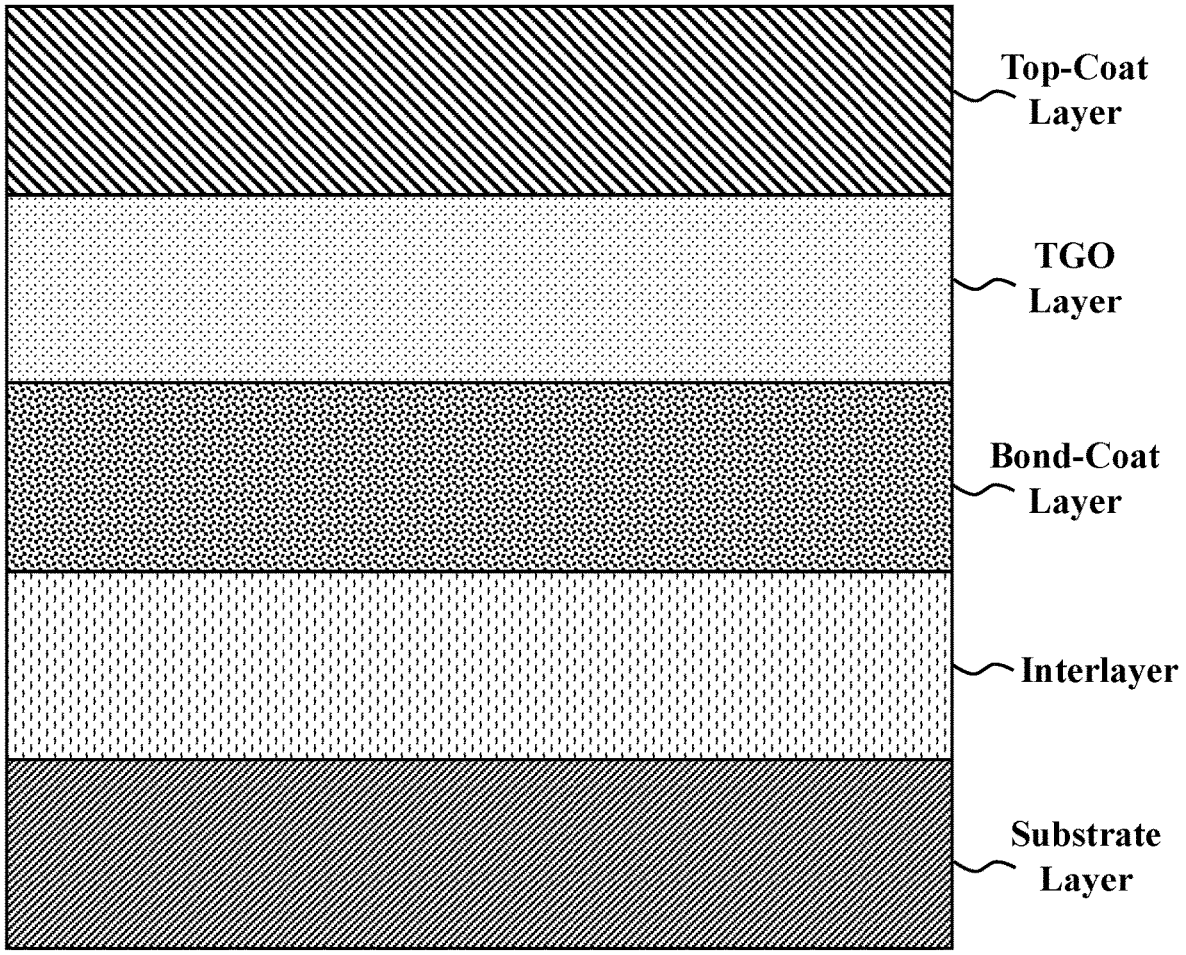
FIG. 1 depicts an exemplary yttrium-containing or lutetium-containing structures of the invention, in which there is a top-coat layer, a thermally grown oxide (TGO) layer, a bond-coat layer, an interlayer, and a substrate layer.

The structures, systems, compositions, and methods of the present invention will be described in detail by reference to various non-limiting embodiments.

This description will enable one skilled in the art to make and use the invention, and it describes several embodiments, adaptations, variations, alternatives, and uses of the invention. These and other embodiments, features, and advantages of the present invention will become more apparent to those skilled in the art when taken with reference to the following detailed description of the invention in conjunction with the accompanying drawings.

As used in this specification and the appended claims, the singular forms "a," "an," and "the" include plural referents unless the context clearly indicates otherwise. Unless defined otherwise, all technical and scientific terms used herein have the same meaning as is commonly understood by one of ordinary skill in the art to which this invention belongs.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phrase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phrase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms, except when used in Markush groups. Thus in some embodiments not otherwise explicitly recited, any instance of "comprising" may be replaced by "consisting of" or, alternatively, by "consisting essentially of."

The present invention is predicated on the design and use of bond coats that contain yttrium (Y) and/or lutetium (Lu), along with one or more noble metals, such as platinum (Pt), iridium (Ir), rhenium (Re), or ruthenium (Ru). These novel bond coats enable coatings that survive at higher temperatures, such as (but not limited to) thermal barrier coatings, compared to state-of-the art alumina-bearing bond coats described in the Background.

Current state-of-the-art bond coats utilize alumina-yielding compositions for nickel-based substrates. However, it is now recognized by the present inventors that alumina-yielding bond coats are not as compatible with improved substrates and top coats as compared to heritage applications using nickel-based substrates and yttria-stabilized zirconia.

Some variations are premised on the realization that for the next generation of advanced thermal barrier coatings and systems, as well as for environmental barrier coatings systems and systems, yttria-yielding bond coats and/or lutecia-yielding bond coats will more effectively bridge the gap between refractory metal or ceramic substrates and an oxide/ceramic top coat (e.g., ceria).

Yttria-yielding bond coats and/or lutecia-yielding bond coats offer several advantages, including: (1) the ability to match the low coefficients of thermal expansion of the substrate; (2) low stiffness/high compliance of yttria or lutecia in order to accommodate thermal strains; and (3) the increased operating temperature as compared to alumina. On the third point, the melting points of Y and Lu are much higher than the melting point of Al (by approximately 1000° C.), and the melting points of $Y_2O_3$ and $Lu_2O_3$ are higher than the melting point of $Al_2O_3$ (by approximately 400° C.).

Through various coating methods, yttrium and/or lutetium can be co-deposited with one or more noble metals to yield yttrium-containing intermetallic compounds (e.g., $YPt_2$) and/or lutetium-containing intermetallic compounds (e.g., $LuPt_3$). In some embodiments, yttrium-containing or lutetium-containing intermetallic compounds can be used as a bond coat within a thermal barrier coating or environmental barrier coating by adhering to the substrate, and then forming a thermally grown oxide (TGO) layer containing yttrium oxide (yttria) or lutetium oxide (lutecia), enabling an oxide/ceramic top coat to be applied and adhered to the bond coat.

Some variations of the invention provide a yttrium-containing structure comprising:

(a) a substrate layer comprising a metal alloy, a ceramic material, a ceramic composite, or a combination thereof;

(b) a bond-coat layer disposed on the substrate layer, or on an optional interlayer that is disposed on the substrate layer, wherein the bond-coat layer comprises yttrium and a noble metal selected from the group consisting of platinum, iridium, rhenium, ruthenium, rhodium, osmium, palladium, and combinations thereof, (c) a thermally grown oxide layer disposed on the bond-coat layer, wherein the thermally grown oxide layer comprises yttrium oxide; and (d) optionally, a top-coat layer disposed on the thermally grown oxide layer, wherein the top-coat layer comprises a metal oxide, a metal pyrochlore, or a metal silicate.

In some embodiments, the metal alloy is selected from the group consisting of Nb alloys, Mo alloys, Ta alloys, W alloys, V alloys, and combinations thereof.

In some embodiments, the ceramic material is selected from the group consisting of aluminum nitride, boron nitride, hafnium carbide, hafnium diboride, hafnium nitride, silicon carbide, silicon nitride, tantalum carbide, titanium carbide, titanium diboride, titanium nitride, zirconium carbide, zirconium diboride, zirconium nitride, and combinations thereof.

In some embodiments, the ceramic composite is selected from the group consisting of carbon-carbon, carbon-silicon carbide, carbon-hafnium carbide, carbon-zirconium carbide, silicon carbide-silicon carbide, and combinations thereof.

In some embodiments, the substrate layer has a thickness from about 10 microns to about 50 millimeters. In various embodiments, the substrate layer has a thickness of about, at least about, or at most about 10 microns, 50 microns, 100 microns, 250 microns, 500 microns, 1 millimeter, 5 millimeters, 10 millimeters, 25 millimeters, or 50 millimeters, including any intervening range.

In some embodiments, the bond-coat layer has a thickness from about 5 nanometers to about 500 microns. In various embodiments, the bond-coat layer has a thickness of about, at least about, or at most about 5 nanometers, 10 nanometers, 50 nanometers, 100 nanometers, 250 nanometers, 500 nanometers, 1 micron, 5 microns, 10 microns, 25 microns, 50 microns, 100 microns, 250 microns, or 500 microns, including any intervening range.

In some embodiments, the bond-coat layer comprises from about 15 mol % to about 50 mol % of yttrium, and from about 50 mol % to about 85 mol % of platinum. In various embodiments, the bond-coat layer comprises about, at least about, or at most about 15 mol %, 20 mol %, 25 mol %, 30 mol %, 35 mol %, 40 mol %, 45 mol %, or 50 mol % of yttrium, including any intervening range; and about, at least about, or at most about 50 mol %, 55 mol %, 60 mol %, 65 mol %, 70 mol %, 75 mol %, 80 mol %, or 85 mol % of platinum, including any intervening range. As an arbitrary example that illustrates intervening ranges, the bond-coat layer may comprise about 30-45 mol % yttrium and about 55-70 mol % platinum, with the condition that the sum cannot exceed 100 mol % but may be less than 100 mol % if other components are present in the bond-coat layer besides Y and Pt.

In some embodiments, the bond-coat layer comprises from about 15 mol % to about 35 mol % of yttrium, and from about 65 mol % to about 85 mol % of iridium. In various embodiments, the bond-coat layer comprises about, at least about, or at most about 15 mol %, 20 mol %, 25 mol %, 30 mol %, or 35 mol % of yttrium, including any intervening range; and about, at least about, or at most about 65 mol %, 70 mol %, 75 mol %, 80 mol %, or 85 mol % of iridium, including any intervening range.

In some embodiments, the bond-coat layer comprises from about 15 mol % to about 50 mol % of yttrium, and from about 50 mol % to about 85 mol % of rhenium. In various embodiments, the bond-coat layer comprises about, at least about, or at most about 15 mol %, 20 mol %, 25 mol %, 30 mol %, 35 mol %, 40 mol %, 45 mol %, or 50 mol % of yttrium, including any intervening range; and about, at least about, or at most about 50 mol %, 55 mol %, 60 mol %, 65 mol %, 70 mol %, 75 mol %, 80 mol %, or 85 mol % of rhenium, including any intervening range.

In some embodiments, the bond-coat layer comprises from about 15 mol % to about 50 mol % of yttrium, and from about 50 mol % to about 85 mol % of ruthenium. In various embodiments, the bond-coat layer comprises about, at least about, or at most about 15 mol %, 20 mol %, 25 mol %, 30 mol %, 35 mol %, 40 mol %, 45 mol %, or 50 mol % of yttrium, including any intervening range; and about, at least about, or at most about 50 mol %, 55 mol %, 60 mol %, 65 mol %, 70 mol %, 75 mol %, 80 mol %, or 85 mol % of ruthenium, including any intervening range.

Typically, in the bond-coat layer, the concentration of yttrium is less than the concentration of noble metal. Alternatively, the concentration of yttrium may be about the same as, or greater than, the concentration of noble metal. For example, in some embodiments, the concentration of yttrium is from about 15 mol % to about 95 mol %, the concentration of noble metal is from about 5 mol % to about 85 mol %, and the concentration of yttrium is higher than the concentration of noble metal (e.g., 75 mol % Y and 25 mol % Pt).

In certain embodiments, the bond-coat layer contains less than 15 mol % yttrium. In various embodiments, regardless of selection of noble metal (e.g., Pt), the bond-coat layer comprises at most about 1 mol %, 2 mol %, 5 mol %, 10 mol %, or 15 mol % of yttrium, including any intervening range.

In some alternative embodiments, a noble metal is additionally or alternatively selected from the group consisting of rhodium (Rh), palladium (Pd), silver (Ag), gold (Au), and osmium (Os). In these embodiments, the bond-coat layer may comprises from about 15 mol % to about 50 mol % of yttrium, and from about 50 mol % to about 85 mol % of one or more noble metals selected from Rh, Pd, Ag, Au, or Os. Combinations of noble metals may be used, including with Pt, Ir, Re, and Ru. In certain embodiments, the bond-coat layer comprises from about 5 mol % to about 50 mol % of yttrium, and from about 50 mol % to about 95 mol % of one or more noble metals selected from Pt, Ir, Re, Ru, Rh, Pd, Ag, Au, or Os.

In preferred embodiments, the bond-coat layer does not contain any aluminum, or contains less than 1 wt % Al, less than 0.5 wt % Al, less than 0.2 wt % Al, less than 0.1 wt % Al, or less than 0.05 wt % Al (e.g., only Al impurities present, if any aluminum at all).

In some embodiments, within the thermally grown oxide layer, the yttrium oxide is $Y_2O_3$. In preferred embodiments, the thermally grown oxide layer does not contain any alumina, or contains less than 0.5 wt % $Al_2O_3$, less than 0.2 wt % $Al_2O_3$, less than 0.1 wt % $Al_2O_3$, less than 0.05 wt % $Al_2O_3$, or less than 0.01 wt % $Al_2O_3$ (e.g., only $Al_2O_3$ impurities present, if any alumina at all).

In some embodiments, the bond-coat layer further comprises lutetium. In these embodiments, the thermally grown oxide layer may further comprise lutetium oxide (e.g., $Lu_2O_3$), such that the thermally grown oxide layer may be a mixture of $Y_2O_3$ and $Lu_2O_3$, for example.

In some embodiments, the thermally grown oxide layer has a thickness from about 10 nanometers to about 100 microns. In various embodiments, the thermally grown oxide layer has a thickness of about, at least about, or at most about 10 nanometers, 50 nanometers, 100 nanometers, 250 nanometers, 500 nanometers, 1 micron, 5 microns, 10 microns, 25 microns, 50 microns, or 100 microns, including any intervening range.

When the interlayer is present in the yttrium-containing structure, the interlayer may have a thickness from about 5 nanometers to about 100 microns, for example. In various embodiments, the interlayer has a thickness of about, at least about, or at most about 5 nanometers, 10 nanometers, 50 nanometers, 100 nanometers, 250 nanometers, 500 nanometers, 1 micron, 5 microns, 10 microns, 25 microns, 50 microns, or 100 microns, including any intervening range.

The interlayer may comprises platinum, iridium, rhenium, ruthenium, rhodium, osmium, palladium, or a combination thereof. These metals may be present in pure form or as compounds, such as oxides, nitrides, carbides, hydrides, hydroxides, intermetallic compounds, metal alloys, or a combination thereof, for example. Taking the example of platinum, the platinum may be present in the interlayer as Pt, $PtO_2$, PtN, PtC, PtH, $Pt(OH)_2$, Pt—Ir alloy, etc.

When the top-coat layer is present in the yttrium-containing structure, the top-coat layer may have a thickness from about 10 nanometers to about 1 millimeter, for example. In various embodiments, the top-coat layer has a thickness of about, at least about, or at most about 10 nanometers, 100 nanometers, 500 nanometers, 1 micron, 5 microns, 10 microns, 50 microns, 100 microns, 200 microns, 500 microns, or 1 millimeter, including any intervening range.

In the top-coat layer (when present), there may be a metal oxide, a metal pyrochlore, a metal silicate, a combination of two of the foregoing, or a combination of all three of the foregoing.

A metal oxide may be selected from rare earth oxides, such as yttria (yttrium oxide, $Y_2O_3$), ceria (cerium oxide, $CeO_2$), gadolinia (gadolinium oxide, $Gd_2O_3$), lanthana (lanthanum oxide, $La_2O_3$), lutecia (lutetium oxide, $Lu_2O_3$), scandia (scandium oxide, $Sc_2O_3$), zirconium oxide (zirconia, $ZrO_2$), hafnium oxide (hafnia, $HfO_2$), or a combination thereof. A metal pyrochlore may be selected from rare earth pyrochlores, such as gadolinium zirconate ($Gd_2Zr_2O_7$), lanthanum zirconate ($La_2Zr_2O_7$), neodymium hafnate ($Ln_2Hf_2O_7$), or a combination thereof. A metal silicate may be selected from rare earth silicates or refractory metal silicates, for example. In some embodiments, a metal silicate is selected from the group consisting of hafnium silicate, yttrium silicate, lutetium silicate, lutetium-yttrium silicate, scandium silicate, scandium-yttrium silicate, zirconium silicate, lanthanum-gallium silicate, gadolinium oxyorthosilicate, and combinations thereof. Any rare earth element (elements 58 to 71) may form a silicate.

Other variations of the invention provide a yttrium-containing intermediate structure comprising:

(a) a substrate layer comprising a metal alloy, a ceramic material, a ceramic composite, or a combination thereof;

(b) optionally, an interlayer disposed on the substrate layer;

(c) a bond-coat layer disposed on the substrate layer, or on the interlayer if present, wherein the bond-coat layer comprises yttrium and a noble metal selected from the group consisting of platinum, iridium, rhenium, ruthenium, rhodium, osmium, palladium, and combinations thereof, and (d) optionally, a top-coat layer disposed on the bond-coat layer, wherein the top-coat layer comprises a metal oxide, a metal pyrochlore, or a metal silicate.

The yttrium-containing intermediate structure may be a structure that has not yet been exposed to oxygen to form a thermally grown oxide layer that contains oxidized yttrium. Alternatively, the yttrium-containing intermediate structure may be a structure that previously contained a thermally grown oxide layer but such layer has been removed, such as by chemical reduction (e.g., using $H_2$) that converts yttrium oxide back to elemental yttrium (e.g., $Y_2O_3+3\ H_2 \rightarrow 2Y+3H_2O$). It is also possible for the yttrium-containing intermediate structure to be a structure that never contains a thermally grown oxide layer. That is, in some applications, no TGO layer is desired or made. For example, a yttrium-containing bond-coat layer may itself function as an environmental barrier coating, protecting the substrate, without the need for a TGO layer or even a top-coat layer.

In typical embodiments, a yttrium-containing intermediate structure is converted to a yttrium-containing structure by making a thermally grown oxide layer disposed on the bond-coat layer. In this conversion, an oxidation source is utilized to oxidize a portion of the yttrium, initially in the bond-coat layer, into yttrium oxide. The oxidation source may be pure oxygen, air, ozone, water, hydroxyl radicals, carbon monoxide, another oxygen-containing gas, or a combination thereof. Typically, the oxidation source is ordinary air. The temperature for oxidation may be selected from about 300° C. to about 1000° C., such as from about 450° C. to about 700° C. The pressure for oxidation may be selected from about 0.1 bar to about 5 bar, typically about 1 bar. The oxidation time may be selected from about 1 minute to about 10 hours, such as from about 2 hours to about 4 hours.

For TGO layer fabrication, the oxidation conditions are preferably selected such that some, but not all, of the yttrium is converted to yttrium oxide in the TGO layer. In some embodiments, the conversion of yttrium to yttrium oxide is selected from about 1% to about 50%, such as from about 5% to about 30%, based on the total content of yttrium in the starting bond-coat layer. In various embodiments, the conversion of yttrium to yttrium oxide is about, at least about, or at most about 1%, 2%, 3%, 4%, 5%, 10%, 15%, 20%, 25%, 30%, 35%, 40%, 45%, or 50%, including any intervening range. In certain embodiments, a conversion to $Y_2O_3$ lower than 1% or higher than 50% is used.

The grown yttrium oxide defines the TGO layer, which increases in thickness for longer reaction times (higher oxidation yield) or higher temperatures (faster oxidation kinetics). If oxidation is well-controlled, the final TGO layer may be well-defined on top of the bond-coat layer, as observable by scanning electron microscopy, for example. In some embodiments, the final TGO layer is somewhat arbitrary in the sense that there is a gradient in concentration of $Y_2O_3$. There may be a region enriched in $Y_2O_3$ and a region that does not contain $Y_2O_3$ (non-oxidized bond-coat layer), and potentially an intermediate region that has some $Y_2O_3$.

In some embodiments of the yttrium-containing intermediate structure, the bond-coat layer comprises from about 15 mol % to about 50 mol % of yttrium, and from about 50 mol % to about 85 mol % of the platinum. In various embodiments, the bond-coat layer comprises about, at least about, or at most about 15 mol %, 20 mol %, 25 mol %, 30 mol %, 35 mol %, 40 mol %, 45 mol %, or 50 mol % of yttrium, including any intervening range; and about, at least about, or at most about 50 mol %, 55 mol %, 60 mol %, 65 mol %, 70 mol %, 75 mol %, 80 mol %, or 85 mol % of platinum, including any intervening range.

In some embodiments, the bond-coat layer comprises from about 15 mol % to about 35 mol % of yttrium, and from about 65 mol % to about 85 mol % of iridium. In various embodiments, the bond-coat layer comprises about, at least about, or at most about 15 mol %, 20 mol %, 25 mol %, 30 mol %, or 35 mol % of yttrium, including any intervening range; and about, at least about, or at most about 65 mol %, 70 mol %, 75 mol %, 80 mol %, or 85 mol % of iridium, including any intervening range.

In some embodiments, the bond-coat layer comprises from about 15 mol % to about 50 mol % of yttrium, and from about 50 mol % to about 85 mol % of rhenium. In various embodiments, the bond-coat layer comprises about, at least about, or at most about 15 mol %, 20 mol %, 25 mol %, 30 mol %, 35 mol %, 40 mol %, 45 mol %, or 50 mol % of yttrium, including any intervening range; and about, at least about, or at most about 50 mol %, 55 mol %, 60 mol %, 65 mol %, 70 mol %, 75 mol %, 80 mol %, or 85 mol % of rhenium, including any intervening range.

In some embodiments, the bond-coat layer comprises from about 15 mol % to about 50 mol % of yttrium, and from about 50 mol % to about 85 mol % of ruthenium. In various embodiments, the bond-coat layer comprises about, at least about, or at most about 15 mol %, 20 mol %, 25 mol %, 30 mol %, 35 mol %, 40 mol %, 45 mol %, or 50 mol % of yttrium, including any intervening range; and about, at least about, or at most about 50 mol %, 55 mol %, 60 mol %, 65 mol %, 70 mol %, 75 mol %, 80 mol %, or 85 mol % of ruthenium, including any intervening range.

In some embodiments, the bond-coat layer further comprises lutetium.

The substrate layer in the yttrium-containing intermediate structure may have a thickness from about 10 microns to about 50 millimeters, for example. In various embodiments, the substrate layer has a thickness of about, at least about, or at most about 10 microns, 50 microns, 100 microns, 250 microns, 500 microns, 1 millimeter, 5 millimeters, 10 millimeters, 25 millimeters, or 50 millimeters, including any intervening range.

The bond-coat layer in the yttrium-containing intermediate structure may have a thickness from about 5 nanometers to about 500 microns, for example. In various embodiments, the bond-coat layer has a thickness of about, at least about, or at most about 5 nanometers, 10 nanometers, 50 nanometers, 100 nanometers, 250 nanometers, 500 nanometers, 1 micron, 5 microns, 10 microns, 25 microns, 50 microns, 100 microns, 250 microns, or 500 microns, including any intervening range.

An interlayer may be present in the yttrium-containing intermediate structure. The interlayer may have a thickness from about 5 nanometers to about 100 microns, for example. In various embodiments, the interlayer has a thickness of about, at least about, or at most about 5 nanometers, 10 nanometers, 50 nanometers, 100 nanometers, 250 nanometers, 500 nanometers, 1 micron, 5 microns, 10 microns, 25 microns, 50 microns, or 100 microns, including any intervening range.

The interlayer may comprise platinum, iridium, rhenium, ruthenium, rhodium, osmium, palladium, or a combination thereof. These metals may be present in pure form or as compounds, such as oxides, nitrides, carbides, hydrides, hydroxides, intermetallic compounds, metal alloys, or a combination thereof, for example.

A top-coat layer may be present in the yttrium-containing intermediate structure. The top-coat layer may have a thickness from about 10 nanometers to about 1 millimeter, for example. In various embodiments, the top-coat layer has a thickness of about, at least about, or at most about 10 nanometers, 100 nanometers, 500 nanometers, 1 micron, 5 microns, 10 microns, 50 microns, 100 microns, 200 microns, 500 microns, or 1 millimeter, including any intervening range Some variations of the invention provide a lutetium-containing structure comprising:

(a) a substrate layer comprising a metal alloy, a ceramic material, a ceramic composite, or a combination thereof;

(b) a bond-coat layer disposed on the substrate layer, or on an optional interlayer that is disposed on the substrate layer, wherein the bond-coat layer comprises lutetium and a noble metal selected from the group consisting of platinum, iridium, rhenium, ruthenium, rhodium, osmium, palladium, and combinations thereof;

(c) a thermally grown oxide layer disposed on the bond-coat layer, wherein the thermally grown oxide layer comprises lutetium oxide; and (d) optionally, a top-coat layer disposed on the thermally grown oxide layer, wherein the top-coat layer comprises a metal oxide, a metal pyrochlore, or a metal silicate.

In some embodiments of lutetium-containing structures, the metal alloy is selected from the group consisting of Nb alloys, Mo alloys, Ta alloys, W alloys, V alloys, and combinations thereof.

In some embodiments of lutetium-containing structures, the ceramic material is selected from the group consisting of aluminum nitride, boron nitride, hafnium carbide, hafnium diboride, hafnium nitride, silicon carbide, silicon nitride, tantalum carbide, titanium carbide, titanium diboride, titanium nitride, zirconium carbide, zirconium diboride, zirconium nitride, and combinations thereof.

In some embodiments of lutetium-containing structures, the ceramic composite is selected from the group consisting of carbon-carbon, carbon-silicon carbide, carbon-hafnium carbide, carbon-zirconium carbide, silicon carbide-silicon carbide, and combinations thereof.

In some embodiments of lutetium-containing structures, the substrate layer has a thickness from about 10 microns to about 50 millimeters. In various embodiments, the substrate layer has a thickness of about, at least about, or at most about 10 microns, 50 microns, 100 microns, 250 microns, 500 microns, 1 millimeter, 5 millimeters, 10 millimeters, 25 millimeters, or 50 millimeters, including any intervening range.

In some embodiments of lutetium-containing structures, the bond-coat layer has a thickness from about 5 nanometers to about 500 microns. In various embodiments, the bond-coat layer has a thickness of about, at least about, or at most about 5 nanometers, 10 nanometers, 50 nanometers, 100 nanometers, 250 nanometers, 500 nanometers, 1 micron, 5 microns, 10 microns, 25 microns, 50 microns, 100 microns, 250 microns, or 500 microns, including any intervening range.

In some embodiments of lutetium-containing structures, the bond-coat layer comprises from about 15 mol % to about 50 mol % of lutetium, and from about 50 mol % to about 85 mol % of platinum. In various embodiments, the bond-coat layer comprises about, at least about, or at most about 15 mol %, 20 mol %, 25 mol %, 30 mol %, 35 mol %, 40 mol %, 45 mol %, or 50 mol % of lutetium, including any intervening range; and about, at least about, or at most about 50 mol %, 55 mol %, 60 mol %, 65 mol %, 70 mol %, 75 mol %, 80 mol %, or 85 mol % of platinum, including any intervening range. As an arbitrary example that illustrates intervening ranges, the bond-coat layer may comprise about 20-35 mol % lutetium and about 60-80 mol % platinum, with the condition that the sum cannot exceed 100 mol % but may be less than 100 mol % if other components are present in the bond-coat layer besides Lu and Pt.

In some embodiments of lutetium-containing structures, the bond-coat layer comprises from about 15 mol % to about 35 mol % of lutetium, and from about 65 mol % to about 85 mol % of iridium. In various embodiments, the bond-coat layer comprises about, at least about, or at most about 15 mol %, 20 mol %, 25 mol %, 30 mol %, or 35 mol % of lutetium, including any intervening range; and about, at least about, or at most about 65 mol %, 70 mol %, 75 mol %, 80 mol %, or 85 mol % of iridium, including any intervening range.

In some embodiments of lutetium-containing structures, the bond-coat layer comprises from about 15 mol % to about 50 mol % of lutetium, and from about 50 mol % to about 85 mol % of rhenium. In various embodiments, the bond-coat layer comprises about, at least about, or at most about 15 mol %, 20 mol %, 25 mol %, 30 mol %, 35 mol %, 40 mol %, 45 mol %, or 50 mol % of lutetium, including any intervening range; and about, at least about, or at most about 50 mol %, 55 mol %, 60 mol %, 65 mol %, 70 mol %, 75 mol %, 80 mol %, or 85 mol % of rhenium, including any intervening range.

In some embodiments of lutetium-containing structures, the bond-coat layer comprises from about 15 mol % to about 50 mol % of lutetium, and from about 50 mol % to about 85 mol % of ruthenium. In various embodiments, the bond-coat layer comprises about, at least about, or at most about 15 mol %, 20 mol %, 25 mol %, 30 mol %, 35 mol %, 40 mol %, 45 mol %, or 50 mol % of lutetium, including any intervening range; and about, at least about, or at most about 50 mol %, 55 mol %, 60 mol %, 65 mol %, 70 mol %, 75 mol %, 80 mol %, or 85 mol % of ruthenium, including any intervening range.

Typically, in the bond-coat layer, the concentration of lutetium is less than the concentration of noble metal. Alternatively, the concentration of lutetium may be about the same as, or greater than, the concentration of noble metal. For example, in some embodiments, the concentration of lutetium is from about 15 mol % to about 95 mol %, the concentration of noble metal is from about 5 mol % to about 85 mol %, and the concentration of lutetium is higher than the concentration of noble metal (e.g., 67 mol % Lu and 33 mol % Ir).

In certain embodiments, the bond-coat layer contains less than 15 mol % lutetium. In various embodiments, regardless of selection of noble metal (e.g., Ir), the bond-coat layer comprises at most about 1 mol %, 2 mol %, 5 mol %, 10 mol %, or 15 mol % of lutetium, including any intervening range.

In some embodiments of lutetium-containing structures, within the thermally grown oxide layer, the lutetium oxide is $Lu_2O_3$.

In some embodiments of lutetium-containing structures, the thermally grown oxide layer has a thickness from about 10 nanometers to about 100 microns. In various embodiments, the thermally grown oxide layer has a thickness of about, at least about, or at most about 10 nanometers, 50 nanometers, 100 nanometers, 250 nanometers, 500 nanometers, 1 micron, 5 microns, 10 microns, 25 microns, 50 microns, or 100 microns, including any intervening range.

When the interlayer is present in the lutetium-containing structure, the interlayer may have a thickness from about 5 nanometers to about 100 microns, for example. In various embodiments, the interlayer has a thickness of about, at least about, or at most about 5 nanometers, 10 nanometers, 50 nanometers, 100 nanometers, 250 nanometers, 500 nanometers, 1 micron, 5 microns, 10 microns, 25 microns, 50 microns, or 100 microns, including any intervening range.

The interlayer may comprise platinum, iridium, rhenium, ruthenium, rhodium, osmium, palladium, or a combination thereof. These metals may be present in pure form or as compounds, such as oxides, nitrides, carbides, hydrides, hydroxides, intermetallic compounds, metal alloys, or a combination thereof, for example.

When the top-coat layer is present, the top-coat layer may have a thickness from about 10 nanometers to about 1 millimeter, for example. In various embodiments, the top-coat layer has a thickness of about, at least about, or at most about 10 nanometers, 100 nanometers, 500 nanometers, 1 micron, 5 microns, 10 microns, 50 microns, 100 microns, 200 microns, 500 microns, or 1 millimeter, including any intervening range In some embodiments of lutetium-containing structures, a metal oxide may be selected from rare earth oxides, such as yttria (yttrium oxide, $Y_2O_3$), ceria (cerium oxide, $CeO_2$), gadolinia (gadolinium oxide, $Gd_2O_3$), lanthana (lanthanum oxide, $La_2O_3$), lutecia (lutetium oxide, $Lu_2O_3$), scandia (scandium oxide, $Sc_2O_3$), zirconium oxide (zirconia, $ZrO_2$), hafnium oxide (hafnia, $HfO_2$), or a combination thereof. A metal pyrochlore may be selected from rare earth pyrochlores, such as gadolinium zirconate ($Gd_2Zr_2O_7$), lanthanum zirconate ($La_2Zr_2O_7$), neodymium hafnate ($Ln_2Hf_2O_7$), or a combination thereof. A metal silicate may be selected from rare earth silicates or refractory metal silicates, for example. In some embodiments, a metal silicate is selected from the group consisting of hafnium silicate, yttrium silicate, lutetium silicate, lutetium-yttrium silicate, scandium silicate, scandium-yttrium silicate, zirconium silicate, lanthanum-gallium silicate, gadolinium oxyorthosilicate, and combinations thereof.

Still other variations provide a lutetium-containing intermediate structure comprising:

(a) a substrate layer comprising a metal alloy, a ceramic material, a ceramic composite, or a combination thereof;

(b) optionally, an interlayer disposed on the substrate layer;

(c) a bond-coat layer disposed on the substrate layer, or on the interlayer if present, wherein the bond-coat layer comprises lutetium and a noble metal selected from the group consisting of platinum, iridium, rhenium, ruthenium, rhodium, osmium, palladium, and combinations thereof, and (d) optionally, a top-coat layer disposed on the bond-coat layer, wherein the top-coat layer comprises a metal oxide, a metal pyrochlore, or a metal silicate.

The lutetium-containing intermediate structure may be a structure that has not yet been exposed to oxygen to form a thermally grown oxide layer that contains oxidized lutetium. Alternatively, the lutetium-containing intermediate structure may be a structure that previously contained a thermally grown oxide layer but such layer has been removed, such as by chemical reduction (e.g., using $H_2$) that converts lutetium oxide back to elemental lutetium (e.g., $Lu_2O_3+3H_2 \rightarrow 2Lu+3H_2O$). It is also possible for the lutetium-containing intermediate structure to be a structure that never contains a thermally grown oxide layer. That is, in some applications, no TGO layer is desired or made. For example, a lutetium-containing bond-coat layer may itself function as an environmental barrier coating, protecting the substrate, without the need for a TGO layer or even a top-coat layer.

In typical embodiments, a lutetium-containing intermediate structure is converted to a lutetium-containing structure by making a thermally grown oxide layer disposed on the bond-coat layer. In this conversion, an oxidation source is utilized to oxidize a portion of the lutetium, initially in the bond-coat layer, into lutetium oxide. The oxidation source may be pure oxygen, air, ozone, water, hydroxyl radicals, carbon monoxide, another oxygen-containing gas, or a combination thereof. Typically, the oxidation source is ordinary air. The temperature for oxidation may be selected from about 300° C. to about 1000° C., such as from about 450° C. to about 700° C. The pressure for oxidation may be selected from about 0.1 bar to about 5 bar, typically about 1 bar. The oxidation time may be selected from about 1 minute to about 10 hours, such as from about 2 hours to about 4 hours.

For TGO layer fabrication, the oxidation conditions are preferably selected such that some, but not all, of the lutetium is converted to lutetium oxide in the TGO layer. In some embodiments, the conversion of lutetium to lutetium oxide is selected from about 1% to about 50%, such as from about 5% to about 30%, based on the total content of lutetium in the starting bond-coat layer. In various embodiments, the conversion of lutetium to lutetium oxide is about, at least about, or at most about 1%, 2%, 3%, 4%, 5%, 10%, 15%, 20%, 25%, 30%, 35%, 40%, 45%, or 50%, including any intervening range. In certain embodiments, a conversion to $Lu_2O_3$ lower than 1% or higher than 50% is used.

In some embodiments of lutetium-containing intermediate structures, the bond-coat layer comprises from about 15 mol % to about 50 mol % of lutetium, and from about 50 mol % to about 85 mol % of platinum. In various embodiments, the bond-coat layer comprises about, at least about, or at most about 15 mol %, 20 mol %, 25 mol %, 30 mol %, 35 mol %, 40 mol %, 45 mol %, or 50 mol % of lutetium, including any intervening range; and about, at least about, or at most about 50 mol %, 55 mol %, 60 mol %, 65 mol %, 70 mol %, 75 mol %, 80 mol %, or 85 mol % of platinum, including any intervening range.

In some embodiments of lutetium-containing intermediate structures, the bond-coat layer comprises from about 15 mol % to about 35 mol % of lutetium, and from about 65 mol % to about 85 mol % of iridium. In various embodiments, the bond-coat layer comprises about, at least about, or at most about 15 mol %, 20 mol %, 25 mol %, 30 mol %, or 35 mol % of lutetium, including any intervening range; and about, at least about, or at most about 65 mol %, 70 mol %, 75 mol %, 80 mol %, or 85 mol % of iridium, including any intervening range.

In some embodiments of lutetium-containing intermediate structures, the bond-coat layer comprises from about 15 mol % to about 50 mol % of lutetium, and from about 50 mol % to about 85 mol % of rhenium. In various embodiments, the bond-coat layer comprises about, at least about, or at most about 15 mol %, 20 mol %, 25 mol %, 30 mol %, 35 mol %, 40 mol %, 45 mol %, or 50 mol % of lutetium, including any intervening range; and about, at least about, or at most about 50 mol %, 55 mol %, 60 mol %, 65 mol %, 70 mol %, 75 mol %, 80 mol %, or 85 mol % of rhenium, including any intervening range.

In some embodiments of lutetium-containing intermediate structures, the bond-coat layer comprises from about 15 mol % to about 50 mol % of lutetium, and from about 50 mol % to about 85 mol % of ruthenium. In various embodiments, the bond-coat layer comprises about, at least about, or at most about 15 mol %, 20 mol %, 25 mol %, 30 mol %, 35 mol %, 40 mol %, 45 mol %, or 50 mol % of lutetium, including any intervening range; and about, at least about, or at most about 50 mol %, 55 mol %, 60 mol %, 65 mol %, 70 mol %, 75 mol %, 80 mol %, or 85 mol % of ruthenium, including any intervening range.

In some embodiments of lutetium-containing intermediate structures, the metal oxide is selected from rare earth oxides or rare earth pyrochlores.

In some embodiments of lutetium-containing intermediate structures, the substrate layer has a thickness from about 10 microns to about 50 millimeters, for example. In various embodiments, the substrate layer has a thickness of about, at least about, or at most about 10 microns, 50 microns, 100 microns, 250 microns, 500 microns, 1 millimeter, 5 millimeters, 10 millimeters, 25 millimeters, or 50 millimeters, including any intervening range.

In some embodiments of lutetium-containing intermediate structures, the bond-coat layer has a thickness from about 5 nanometers to about 500 microns, for example. In various embodiments, the bond-coat layer has a thickness of about, at least about, or at most about 5 nanometers, 10 nanometers, 50 nanometers, 100 nanometers, 250 nanometers, 500 nanometers, 1 micron, 5 microns, 10 microns, 25 microns, 50 microns, 100 microns, 250 microns, or 500 microns, including any intervening range.

In some embodiments of lutetium-containing intermediate structures, the interlayer is present and has a thickness from about 5 nanometers to about 100 microns, for example. In various embodiments, the interlayer has a thickness of about, at least about, or at most about 5 nanometers, 10 nanometers, 50 nanometers, 100 nanometers, 250 nanometers, 500 nanometers, 1 micron, 5 microns, 10 microns, 25 microns, 50 microns, or 100 microns, including any intervening range.

The interlayer (when present) may comprise platinum, iridium, rhenium, ruthenium, rhodium, osmium, palladium, or a combination thereof. These metals may be present in pure form or as compounds, such as oxides, nitrides, carbides, hydrides, hydroxides, intermetallic compounds, metal alloys, or a combination thereof, for example.

In some embodiments of lutetium-containing intermediate structures, the top-coat layer is present and has a thickness from about 10 nanometers to about 1 millimeter, for example. In various embodiments, the top-coat layer has a thickness of about, at least about, or at most about 10 nanometers, 100 nanometers, 500 nanometers, 1 micron, 5 microns, 10 microns, 50 microns, 100 microns, 200 microns, 500 microns, or 1 millimeter, including any intervening range Some variations of the invention employ a mixture of yttrium and lutetium in the bond-coat layer.

In some embodiments, the bond-coat layer comprises from about 15 mol % to about 50 mol % of a mixture of yttrium and lutetium, and from about 50 mol % to about 85 mol % of platinum. In various embodiments, the bond-coat layer comprises about, at least about, or at most about 15 mol %, 20 mol %, 25 mol %, 30 mol %, 35 mol %, 40 mol %, 45 mol %, or 50 mol % of a mixture of yttrium and lutetium, including any intervening range; and about, at least about, or at most about 50 mol %, 55 mol %, 60 mol %, 65 mol %, 70 mol %, 75 mol %, 80 mol %, or 85 mol % of platinum, including any intervening range.

In some embodiments, the bond-coat layer comprises from about 15 mol % to about 35 mol % of a mixture of yttrium and lutetium, and from about 65 mol % to about 85 mol % of iridium. In various embodiments, the bond-coat layer comprises about, at least about, or at most about 15 mol %, 20 mol %, 25 mol %, 30 mol %, or 35 mol % of a mixture of yttrium and lutetium, including any intervening range; and about, at least about, or at most about 65 mol %, 70 mol %, 75 mol %, 80 mol %, or 85 mol % of iridium, including any intervening range.

In some embodiments, the bond-coat layer comprises from about 15 mol % to about 50 mol % of a mixture of yttrium and lutetium, and from about 50 mol % to about 85 mol % of rhenium. In various embodiments, the bond-coat layer comprises about, at least about, or at most about 15 mol %, 20 mol %, 25 mol %, 30 mol %, 35 mol %, 40 mol %, 45 mol %, or 50 mol % of a mixture of yttrium and lutetium, including any intervening range; and about, at least about, or at most about 50 mol %, 55 mol %, 60 mol %, 65 mol %, 70 mol %, 75 mol %, 80 mol %, or 85 mol % of rhenium, including any intervening range.

In some embodiments, the bond-coat layer comprises from about 15 mol % to about 50 mol % of a mixture of yttrium and lutetium, and from about 50 mol % to about 85 mol % of ruthenium. In various embodiments, the bond-coat layer comprises about, at least about, or at most about 15 mol %, 20 mol %, 25 mol %, 30 mol %, 35 mol %, 40 mol %, 45 mol %, or 50 mol % of a mixture of yttrium and lutetium, including any intervening range; and about, at least about, or at most about 50 mol %, 55 mol %, 60 mol %, 65 mol %, 70 mol %, 75 mol %, 80 mol %, or 85 mol % of ruthenium, including any intervening range.

In such embodiments employing a mixture of yttrium and lutetium, the molar ratio of yttrium to lutetium, Y/Lu, may vary widely, such as from about 0.01 to about 100 (mol/mol). In various embodiments employing a mixture of yttrium and lutetium, the molar Y/Lu ratio is about, at least about, or at most about 0.01, 0.05, 0.1, 0.2, 0.5, 0.8, 1.0, 1.2, 1.5, 2, 5, 10, 20, 50, or 100, including any intervening range.

When a mixture of yttrium and lutetium is employed in the bond-coat layer, the thermally grown oxide layer may have the same molar ratio of Y/Lu as in the bond-coat layer, or the ratio may be different if the degree of oxidation differs between yttrium and lutetium. For example, yttrium is preferentially oxidized to $Y_2O_3$ compared to lutetium being oxidized to $Lu_2O_3$, then the molar ratio of $Y_2O_3/Lu_2O_3$ in the TGO layer is expected to be slightly higher than the Y/Lu molar ratio in the bond-coat layer.

Other variations of the invention utilize a mixture of multiple noble metals. In some embodiments, the bond-coat layer comprises from about 15 mol % to about 50 mol % of yttrium and/or lutetium, and from about 50 mol % to about 85 mol % of one or more noble metals selected from platinum, iridium, rhenium, ruthenium, rhodium, osmium, or palladium. In various embodiments, the bond-coat layer comprises about, at least about, or at most about 15 mol %, 20 mol %, 25 mol %, 30 mol %, 35 mol %, 40 mol %, 45 mol %, or 50 mol % of yttrium and/or lutetium, including any intervening range; and about, at least about, or at most about 50 mol %, 55 mol %, 60 mol %, 65 mol %, 70 mol %, 75 mol %, 80 mol %, or 85 mol % of one or more noble metals selected from platinum, iridium, rhenium, ruthenium, rhodium, osmium, or palladium, including any intervening range. As just one possible example, the mixture of noble metals may be 50 mol % Ir and 50 mol % Pt.

FIGS. 1 to 5 depict exemplary yttrium-containing or lutetium-containing structures of the invention. These two-dimensional drawings are illustrative of three-dimensional layer configurations, and are not drawn to scale.

In FIG. 1, there is a top-coat layer disposed on a thermally grown oxide (TGO) layer, which is disposed on a bond-coat layer, which is disposed on an interlayer, which is disposed on a substrate layer. Exemplary compositions for each layer are described above.

Figure 2:
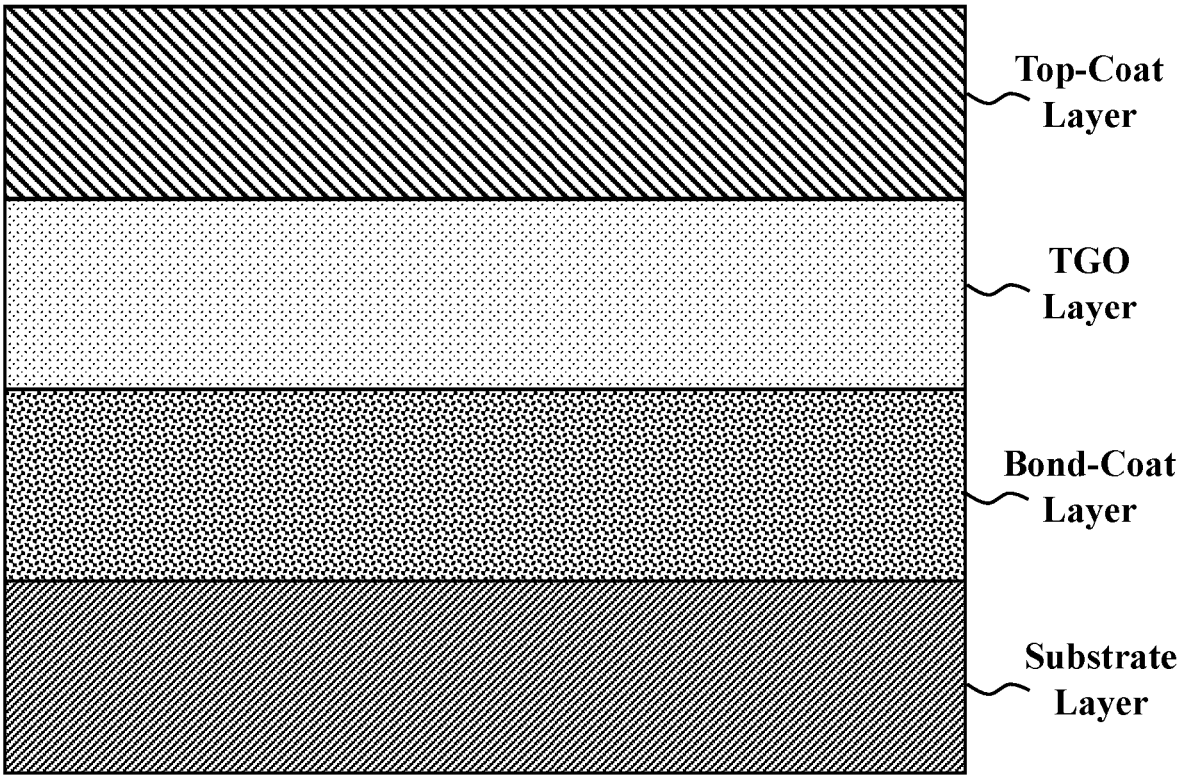
FIG. 2 depicts an exemplary yttrium-containing or lutetium-containing structures of the invention, in which there is a top-coat layer, a thermally grown oxide (TGO) layer, a bond-coat layer, and a substrate layer.

In FIG. 2, there is a top-coat layer disposed on a thermally grown oxide (TGO) layer, which is disposed on a bond-coat layer, which is disposed on a substrate layer. Exemplary compositions for each layer are described above.

Figure 3:
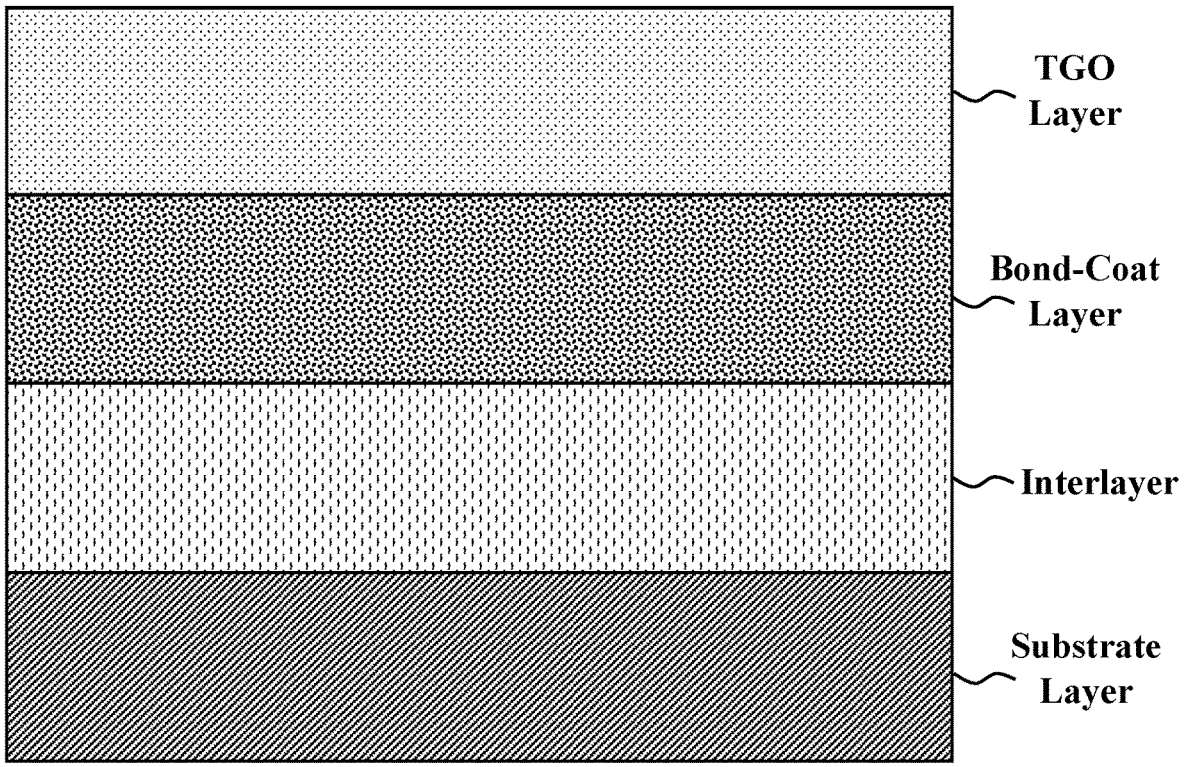
FIG. 3 depicts an exemplary yttrium-containing or lutetium-containing structures of the invention, in which there is a thermally grown oxide (TGO) layer, a bond-coat layer, an interlayer, and a substrate layer.

In FIG. 3, there is a thermally grown oxide (TGO) layer, which is disposed on a bond-coat layer, which is disposed on an interlayer, which is disposed on a substrate layer. Exemplary compositions for each layer are described above.

Figure 4:
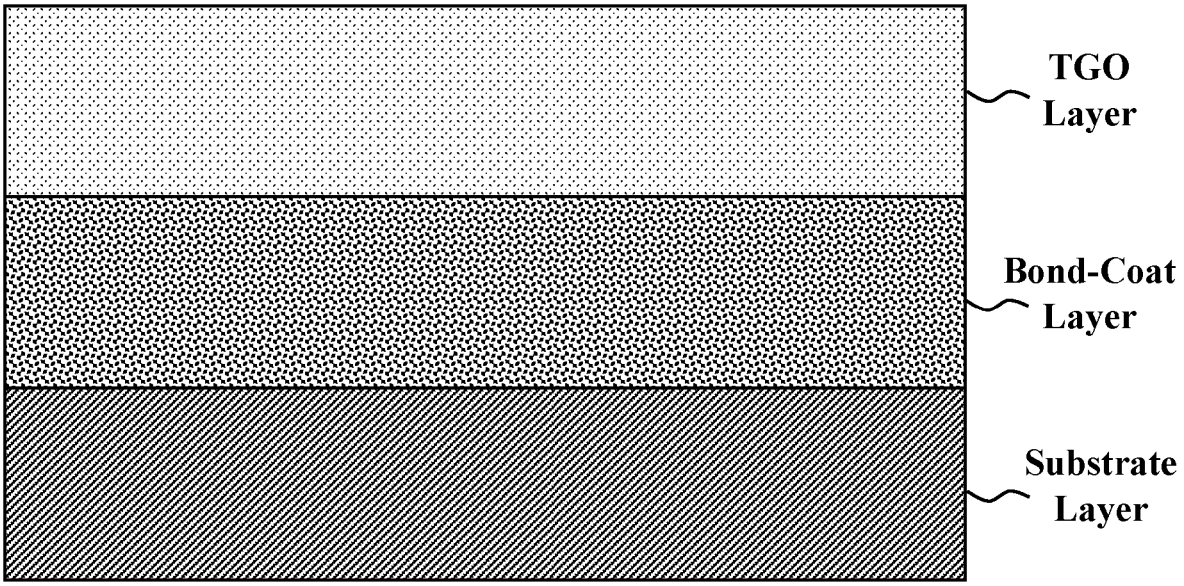
FIG. 4 depicts an exemplary yttrium-containing or lutetium-containing structures of the invention, in which there is a thermally grown oxide (TGO) layer, a bond-coat layer, and a substrate layer.

In FIG. 4, there is a thermally grown oxide (TGO) layer, which is disposed on a bond-coat layer, which is disposed on a substrate layer. Exemplary compositions for each layer are described above.

Figure 5:
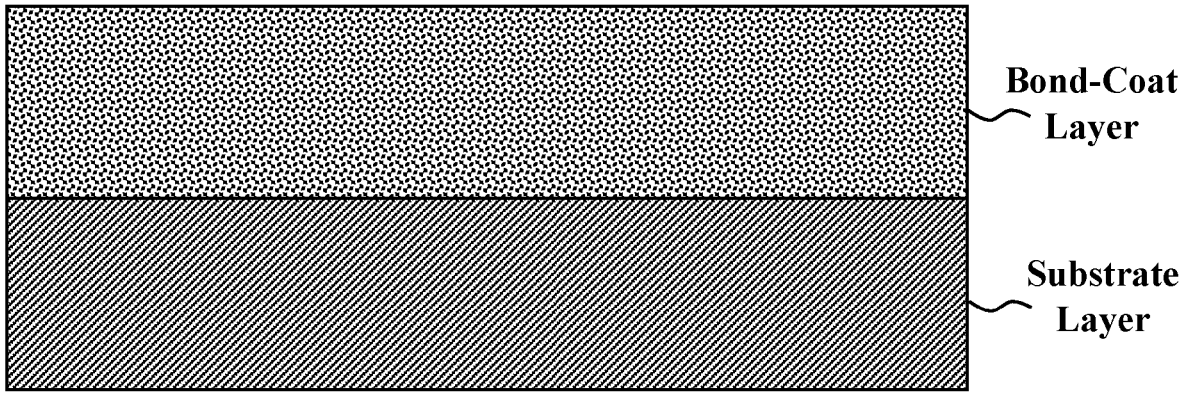
FIG. 5 depicts an exemplary yttrium-containing or lutetium-containing intermediate structure of the invention, in which there is a bond-coat layer disposed on a substrate layer. The intermediate structure is present prior to growth of a TGO layer, for example.

In FIG. 5, there is a bond-coat layer, which is disposed on a substrate layer. Exemplary compositions for each layer are described above. FIG. 5 depicts a yttrium-containing or lutetium-containing intermediate structure, prior to growth of a TGO layer, or after a TGO layer has been removed. FIG. 5 also depicts a yttrium-containing or lutetium-containing structure that does not ever have a significant TGO layer.

In FIGS. 1-4, the TGO layer may be uniform or non-uniform, depending on the conditions of TGO growth. There is not necessarily a sharp interface between the TGO layer and the bond-coat layer, as implied in these drawings.

The common layers in all of FIGS. 1-5 are the substrate layer and the bond-coat layer. A substrate layer will be present when a substrate is being protected, such as from high temperature or the environment. It is possible for there to be other layers or components under the substrate, such as a bulk structure, open space, or various other solids, liquids, or vapors.

As described above, the bond-coat layer contains at least one of Y or Lu, as well as at least one noble metal (e.g., Pt or Ir). The specific chemistry between the Y (and/or Lu) and the noble metal(s) will generally depend on the concentrations of each component, the processing conditions, and the conditions under use. Generally, there may be an intermetallic compound between the Y (and/or Lu) and the noble metal(s), a solid solution of the Y (and/or Lu) with the noble metal(s), or a system in which at least one component is not dissolved in the other component(s). There may be, but is not necessarily, a chemical or metallic bond between the Y (or Lu) and the noble metal(s). The components in the bond-coat layer may be at equilibrium, or may depart from the equilibrium concentrations predicted by a thermodynamic phase diagram.

Equilibrium solubilities of elements in multicomponent systems may be predicted. For example, see *Smithells Metals Reference Book*, Eds. Gale and Totemeier, Eighth Edition, 2004, which is hereby incorporated by reference. When more than two elements are present in the bond-coat layer, the equilibrium phase diagrams become more complex due to thermodynamic interactions and among each element, in addition to chemical reactions (e.g., Y oxidation to $Y_2O_3$). One skilled in the materials-science art will understand that multicomponent phase diagrams may be found in the literature, or if not readily available, may be generated via experimentation.

Phases of interest when yttrium and platinum are contained in the bond-coat layer include Pt, $YPt_3$, $YPt_2$, and YPt, for example. Phases of interest when yttrium and iridium are contained in the bond-coat layer include Ir, $YIr_3$, $YIr_2$, YIr, for example. Phases of interest when yttrium and rhenium are contained in the bond-coat layer include Re and $YRe_2$, for example. Phases of interest when yttrium and ruthenium are contained in the bond-coat layer include Ru and $YRu_2$, for example.

Phases of interest when lutetium and platinum are contained in the bond-coat layer include Pt, $LuPt_3$, $LuPt_2$, and LuPt, for example. Phases of interest when lutetium and iridium are contained in the bond-coat layer include Ir, $LuIr_3$, $LyIr_2$, LuIr, for example. Phases of interest when lutetium and rhenium are contained in the bond-coat layer include Re and $LuRe_2$, for example. Phases of interest when lutetium and ruthenium are contained in the bond-coat layer include Ru and $LuRu_2$, for example.

Various methods may be employed to fabricate the different layers of the yttrium-containing or lutetium-containing structure. Generally, chemical vapor deposition (such as chemical vapor co-deposition), physical vapor deposition (such as sputtering, co-sputtering, or electron-beam deposition), chemical plating, chemical diffusion, plasma spraying, vacuum spraying, air-assisted impingement, noble-gas-assisted impingement, additive manufacturing, or a combination thereof, may be utilized to fabricate one or more layers.

The thermally grown oxide (TGO) layer is preferably made by oxidizing a portion of the yttrium and/or lutetium in the bond-coat layer, or in a TGO-precursor layer that contains the same composition as the bond-coat layer or at least contains yttrium and/or lutetium. The TGO layer may be fabricated in situ during use of the structure, typically utilizing ambient air for its oxygen content, or potentially other oxygen-containing compounds in the atmosphere (e.g., $H_2O$, $O_3$, or OH). Alternatively, the TGO layer may be fabricated during initial formation of the structure. In this case, if there is a top-coat layer (e.g., FIG. 1), the TGO layer may be made prior to making the top-coat layer. For example, the TGO layer may be made using atmospheric-pressure air in a furnace to grow the TGO later, followed by fabricating the top-coat layer, such as with a plasma spray. In certain embodiments, the top-coat layer is made, and then the TGO layer is made, which is possible if the metal oxide in the top-coat layer allows sufficient permeability of oxygen through the layer to reach the bond-coat layer. Also, a combination of the above approaches may be carried out. For example, a first part of a TGO layer may be made initially upon production of the structure, and then a second part of the TGO layer may be made in situ during use of the structure.

During growth of a TGO layer, whether done initially or during use, oxidation is carried out using air or oxygen, typically as follows:

$$2Y+1.5O_2 \rightarrow Y_2O_3$$

$$2Lu+1.5O_2 \rightarrow Lu_2O_3$$

While other oxides besides $Y_2O_3$ (yttria) or $Lu_2O_3$ (lutecia) can theoretically be made, such as yttrium monoxide (YO), yttria and lutecia are thermodynamically favorable in most cases. Also, other oxidants besides $O_2$ may in principle be used, such as ozone ($O_3$) or ozone photolysis products (e.g., hydroxyl radicals, OH); using the oxygen content of ordinary air is usually convenient.

The disclosed structures may be thermal barrier coatings or environmental barrier coatings, for example. The disclosed structures can be used for thermal barrier coatings in commercial jet turbine engines or engine components, in addition to defense applications such as hypersonic air-breathing propulsion or hypersonic propulsion engine components, for example. The disclosed structures can be used for environmental barrier coatings for leading edges, control surfaces, acreage shells, aeroshells, and other supersonic or hypersonic components. The disclosed structures can be used for environmental barrier coatings for protection against undesired metal oxidation. Some embodiments of the disclosed technology enable an increase in operating temperature for the next generation of refractory metal and ceramic substrate materials necessary for higher thermodynamic turbine efficiencies and/or for higher-speed applications.

EXAMPLE

A yttrium-containing structure is fabricated experimentally. The substrate layer is sapphire. The bond-coat layer comprises yttrium (Y) and platinum (Pt). The thermally grown oxide (TGO) layer comprises yttrium oxide ($Y_2O_3$). The top-coat layer comprises $Y_2O_3$.

The bond-coat layer is fabricated by co-sputtering Y and Pt in a 1:1 molar ratio onto the substrate layer, forming a YPt layer that is approximately 1 μm thick.

The TGO layer is fabricated by growing $Y_2O_3$ via oxidation in a furnace in an air atmosphere at a pressure of 1 bar, temperatures from about 450° C. to 700° C., and times ranging from about 2 hours to about 4 hours. Several experiments are carried out, varying the time and temperature over these ranges, resulting in oxide thicknesses from about 50 nanometers to about 300 nanometers (thicker at higher temperature and/or longer reaction time).

The top-coat layer is then made by plasma spraying $Y_2O_3$ onto the TGO layer. The top-coat layer has a thickness of about 25 microns, and can easily be made to a thickness of 2 millimeters or more by varying the conditions of the plasma spray.

This Example demonstrates that actual production of a yttrium-containing structure comprising: (a) a substrate layer comprising a ceramic material (sapphire); (b) a bond-coat layer disposed on the substrate layer, wherein the bond-coat layer comprises yttrium and a noble metal (platinum); (c) a thermally grown oxide layer disposed on the bond-coat layer, wherein the thermally grown oxide layer comprises yttrium oxide; and (d) a top-coat layer disposed on the thermally grown oxide layer, wherein the top-coat layer comprises a metal oxide (yttrium oxide).

In this detailed description, reference has been made to multiple embodiments and to the accompanying drawings in which are shown by way of illustration specific exemplary embodiments of the invention. These embodiments are described in sufficient detail to enable those skilled in the art to practice the invention, and it is to be understood that modifications to the various disclosed embodiments may be made by a skilled artisan.

Where methods and steps described above indicate certain events occurring in certain order, those of ordinary skill in the art will recognize that the ordering of certain steps may be modified and that such modifications are in accordance with the variations of the invention. Additionally, certain steps may be performed concurrently in a parallel process when possible, as well as performed sequentially.

All publications, patents, and patent applications cited in this specification are herein incorporated by reference in their entirety as if each publication, patent, or patent application were specifically and individually put forth herein.

The embodiments, variations, and figures described above should provide an indication of the utility and versatility of the present invention. Other embodiments that do not provide all of the features and advantages set forth herein may also be utilized, without departing from the spirit and scope of the present invention. Such modifications and variations are considered to be within the scope of the invention defined by the claims.

What is claimed is:

1. A yttrium-containing structure comprising:

(a) a substrate layer comprising a metal alloy, a ceramic material, a ceramic composite, or a combination thereof;

(b) a bond-coat layer disposed on said substrate layer, or on an optional interlayer that is disposed on said substrate layer, wherein said bond-coat layer comprises yttrium and a noble metal selected from the group consisting of platinum, iridium, rhenium, ruthenium, rhodium, osmium, palladium, and combinations thereof, (c) a thermally grown oxide layer disposed on said bond-coat layer, wherein said thermally grown oxide layer consists of yttrium oxide; and (d) a top-coat layer disposed on said thermally grown oxide layer, wherein said top-coat layer comprises a metal oxide, a metal pyrochlore, or a metal silicate.

2. The yttrium-containing structure of claim 1, wherein said metal alloy is selected from the group consisting of Nb alloys, Mo alloys, Ta alloys, W alloys, V alloys, and combinations thereof.

3. The yttrium-containing structure of claim 1, wherein said ceramic material is selected from the group consisting of aluminum nitride, boron nitride, hafnium carbide, hafnium diboride, hafnium nitride, silicon carbide, silicon nitride, tantalum carbide, titanium carbide, titanium diboride, titanium nitride, zirconium carbide, zirconium diboride, zirconium nitride, and combinations thereof.

4. The yttrium-containing structure of claim 1, wherein said ceramic composite is selected from the group consisting of carbon-carbon, carbon-silicon carbide, carbon-hafnium carbide, carbon-zirconium carbide, silicon carbide-silicon carbide, and combinations thereof.

5. The yttrium-containing structure of claim 1, wherein said substrate layer has a thickness from 10 microns to 50 millimeters.

6. The yttrium-containing structure of claim 1, wherein said bond-coat layer has a thickness from 5 nanometers to 500 microns.

7. The yttrium-containing structure of claim 1, wherein said bond-coat layer comprises from 15 mol % to 50 mol % of said yttrium, and from about 50 mol % to about 85 mol % of said platinum.

8. The yttrium-containing structure of claim 1, wherein said bond-coat layer comprises from 15 mol % to 35 mol % of said yttrium, and from about 65 mol % to about 85 mol % of said iridium.

9. The yttrium-containing structure of claim 1, wherein said bond-coat layer comprises from 15 mol % to 50 mol % of said yttrium, and from 50 mol % to about 85 mol % of said rhenium.

10. The yttrium-containing structure of claim 1, wherein said bond-coat layer comprises from 15 mol % to 50 mol % of said yttrium, and from 50 mol % to 85 mol % of said ruthenium.

11. The yttrium-containing structure of claim 1, wherein said bond-coat layer further comprises lutetium.

12. The yttrium-containing structure of claim 1, wherein within said thermally grown oxide layer, said yttrium oxide is $Y_2O_3$.

13. The yttrium-containing structure of claim 1, wherein said thermally grown oxide layer has a thickness from about 10 nanometers to about 100 microns.

14. The yttrium-containing structure of claim 1, wherein said interlayer is present.

15. The yttrium-containing structure of claim 14, wherein said interlayer has a thickness from 5 nanometers to 100 microns.

16. The yttrium-containing structure of claim 14, wherein said interlayer comprises platinum, iridium, rhenium, ruthenium, rhodium, osmium, palladium, or a combination thereof.

17. The yttrium-containing structure of claim 1, wherein said top-coat layer is present and has a thickness from 10 nanometers to 1 millimeter.

18. The yttrium-containing structure of claim 1, wherein said metal oxide is selected from rare earth oxides, and wherein said rare earth oxides are selected from the group consisting of yttria, ceria, gadolinia, lanthana, lutecia, scandia, zirconia, hafnia, and combinations thereof.

19. The yttrium-containing structure of claim 1, wherein said metal pyrochlore is selected from rare earth pyrochlores, and wherein said rare earth pyrochlores are selected from the group consisting of gadolinium zirconate, lanthanum zirconate, neodymium hafnate, and combinations thereof.

20. The yttrium-containing structure of claim 1, wherein said metal silicate is selected from the group consisting of hafnium silicate, yttrium silicate, lutetium silicate, lutetium-yttrium silicate, scandium silicate, scandium-yttrium silicate, zirconium silicate, lanthanum-gallium silicate, gadolinium oxyorthosilicate, and combinations thereof.

21. A yttrium-containing intermediate structure comprising:

(a) a substrate layer comprising a metal alloy, a ceramic material, a ceramic composite, or a combination thereof;

(b) an interlayer disposed on said substrate layer;

(c) a bond-coat layer disposed on said interlayer, wherein said bond-coat layer comprises from 15 mol % to 50 mol % yttrium and a noble metal selected from the group consisting of platinum, iridium, rhenium, ruthenium, rhodium, osmium, palladium, and combinations thereof, and wherein said bond-coat layer further comprises lutetium; and (d) a top-coat layer disposed on said bond-coat layer, wherein said top-coat layer comprises a metal oxide, a metal pyrochlore, or a metal silicate.

22. The yttrium-containing intermediate structure of claim 21, wherein said bond-coat layer comprises from 50 mol % to 85 mol % of said platinum.

23. The yttrium-containing intermediate structure of claim 21, wherein said bond-coat layer comprises from 15 mol % to 35 mol % of said yttrium, and from 65 mol % to 85 mol % of said iridium.

24. The yttrium-containing intermediate structure of claim 21, wherein said bond-coat layer comprises from 50 mol % to 85 mol % of said rhenium.

25. The yttrium-containing intermediate structure of claim 21, wherein said bond-coat layer comprises from 50 mol % to 85 mol % of said ruthenium.

26. The yttrium-containing intermediate structure of claim 21, wherein said substrate layer has a thickness from 10 microns to 50 millimeters.

27. The yttrium-containing intermediate structure of claim 21, wherein said bond-coat layer has a thickness from 5 nanometers to 500 microns.

28. The yttrium-containing intermediate structure of claim 21, wherein said interlayer is present and has a thickness from 5 nanometers to 100 microns, and wherein said interlayer optionally comprises platinum, iridium, rhenium, ruthenium, rhodium, osmium, palladium, or a combination thereof.

29. The yttrium-containing intermediate structure of claim 21, wherein said top-coat layer has a thickness from 10 nanometers to 1 millimeter.

* * * * *